United States Patent [19]

Chen

[11] Patent Number: 4,957,023

[45] Date of Patent: Sep. 18, 1990

[54] WRAP DISPENSER WITH AUTOMATIC CUTTING DEVICE

[76] Inventor: Stephen Chen, No. 53, Lane 536, Chang Tsao Road, Changhua, Taiwan

[21] Appl. No.: 343,702

[22] Filed: Apr. 27, 1989

[51] Int. Cl.[5] ..... B26D 5/38

[52] U.S. Cl. ..... 83/372; 83/578; 83/614; 83/649

[58] Field of Search ..... 83/370, 614, 649, 856, 83/484, 372, 578

[56] References Cited

U.S. PATENT DOCUMENTS

| | | | |
|---|---|---|---|
| 3,240,093 | 3/1966 | Bell, Jr. et al. | 83/614 |
| 3,688,625 | 9/1972 | Thomas et al. | 83/614 |
| 3,748,939 | 7/1973 | Feinstein et al. | 83/370 |
| 3,986,419 | 10/1976 | Cleghorn | 83/455 |
| 4,286,488 | 9/1981 | Mason | 83/649 |
| 4,817,483 | 4/1989 | Ambruster | 83/649 |

*Primary Examiner*—Frank T. Yost
*Assistant Examiner*—Scott A. Smith
*Attorney, Agent, or Firm*—Browdy & Neimark

[57] ABSTRACT

An improved plastic wrap dispenser having a battery-operated cutting device adapted for cutting a section of thin plastic wrap off a roll thereof, commonly used to cover the top of containers with foods, fruits and vegetables received therein. A cutting device fixed on a mount is able to be slidably moved along a fixed track by way of a transmission mechanism powered by a motor which is in turn actuated by a number of batteries. Thus, a person can get hold of both corners of the outward extended thin plastic wrap and make a smooth and continuous cut without getting the dispensed thin plastic wrap messed up.

7 Claims, 4 Drawing Sheets

WRAP DISPENSER WITH AUTOMATIC CUTTING DEVICE

FIELD OF THE INVENTION

The present invention relates to an improved wrap dispenser having an automatic cutting device for smoothly detaching a section of thin plastic wrap from a roll thereof which is used to cover foods, fresh vegetables and fruits placed especially in a refrigerator or place of the like. An electrical power source is disposed within the casing of the present cutting device so to provide the necessary power to operate a transmission mechanism.

A cutting blade fixed on a movable mount is made to slide linearly in a back-and-forth manner, once a limiting switch is actuated, by the transmission mechanism so that when the thin plastic wrap is extended from the roll by pulling, the cutting blade is actuated to move to smoothly cut the extended section of wrap off the roll.

Generally speaking, many people living in a modern society are used to cover their foods, fresh vegetables and fruits with a piece of thin plastic wrap, cut from a roll thereof, before putting them in a refrigerator, either for the protection of the same from losing moisture therein, or for the prevention of objectionable odor spreading in the refrigerator. The conventional thin plastic wrap is usually rolled on a rod and dispensed by pulling outward a section thereof for use, the extended thin plastic wrap is then cut off either by a knife or by a zig-zag cutting device attached along the edge of the box in which the roll of wrap is housed.

The problem with the prior art is that such cut thin plastic wrap is easily distorted by sticking to each other in a mess due to static electricity thereon. In most cases, with one hand holding the cutting knife or pulling the thin wrap 22 against the zig-zag cutting edge 21, the dispensed thin plastic wrap is easily messed up.

The inventor has noticed the inconvenience and disadvantages with the prior art, and worked out an improved plastic wrap dispenser which is equipped with an automatic cutting device to detach a section of thin plastic wrap from a roll thereof with smoothness and ease.

SUMMARY OF THE INVENTION

Therefore, the primary object of the present invention is to provide an improved plastic wrap dispenser having an automatically operated cutting device by powered batteries, which is mounted on a cutting blade mount actuated to move by a motor of a transmission mechanism. The cutting blade mount is coupled to the motor by an extended pull cord, and the motor is controlled by a limiting switch which is exposed within the reach of the outward pulled thin plastic wrap as long as this section is held toward the housing of the present invention. Thus, the cutting blade is able to slide linearly along a track in reciprocal manner as to cut a dispensed thin plastic wrap off the roll thereof.

DETAILED DESCRIPTION OF PREFERRED EMBODIMENT

Figure 1:
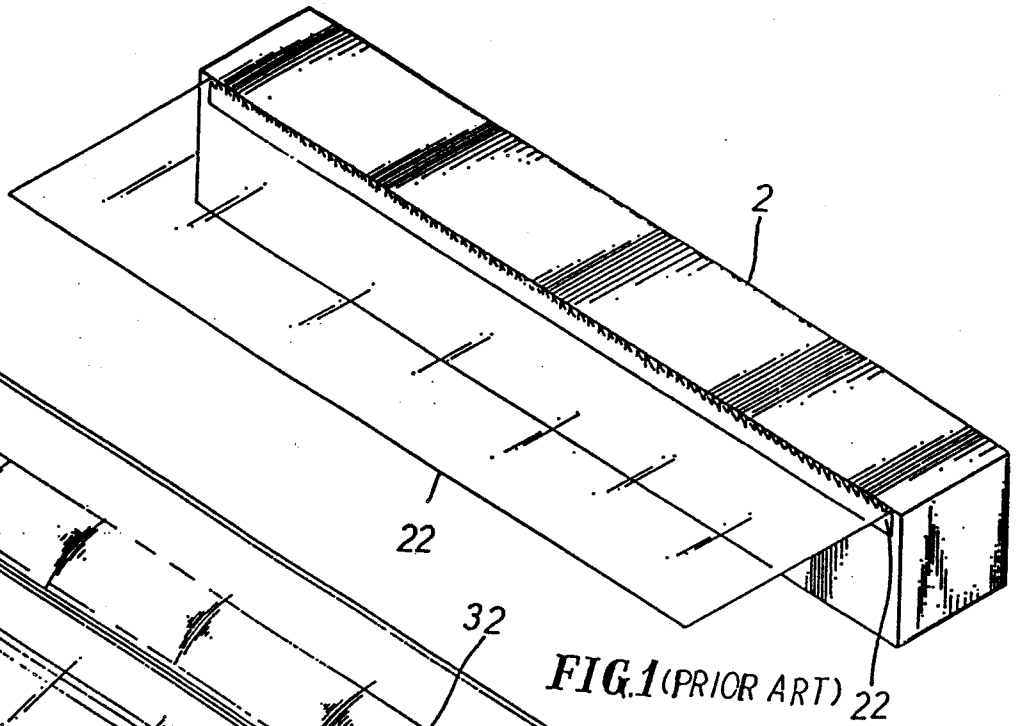
FIG.1 (PRIOR ART)
FIG. 1 is a diagram showing the most popular thin plastic wrap dispenser of the prior art.
Figure 2:
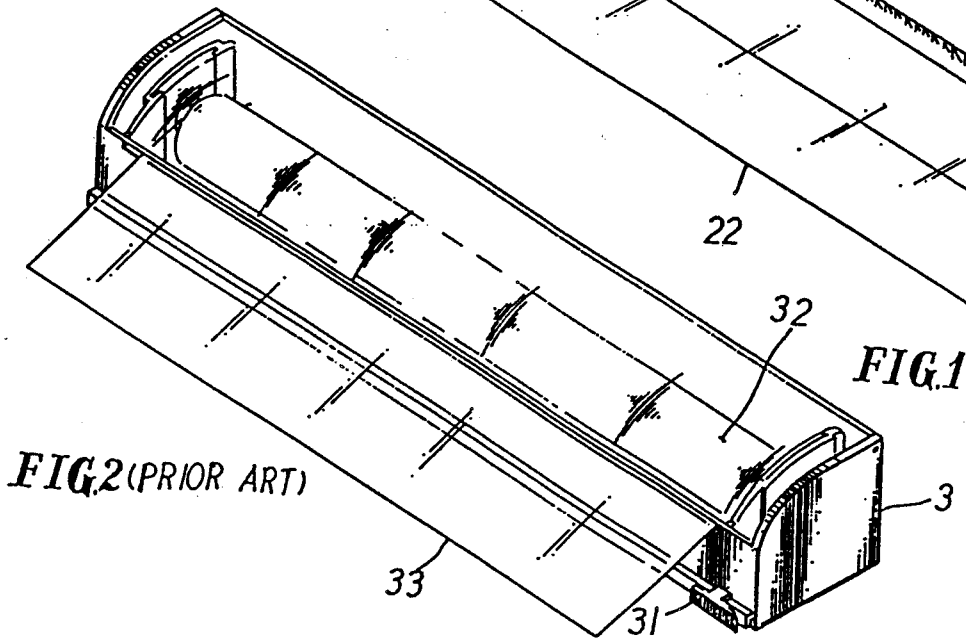
FIG.2 (PRIOR ART)
FIG. 2 is a diagram showing another kind of wrap dispenser of the prior art, equipped with a hand-operated cutting blade.
Figure 3:
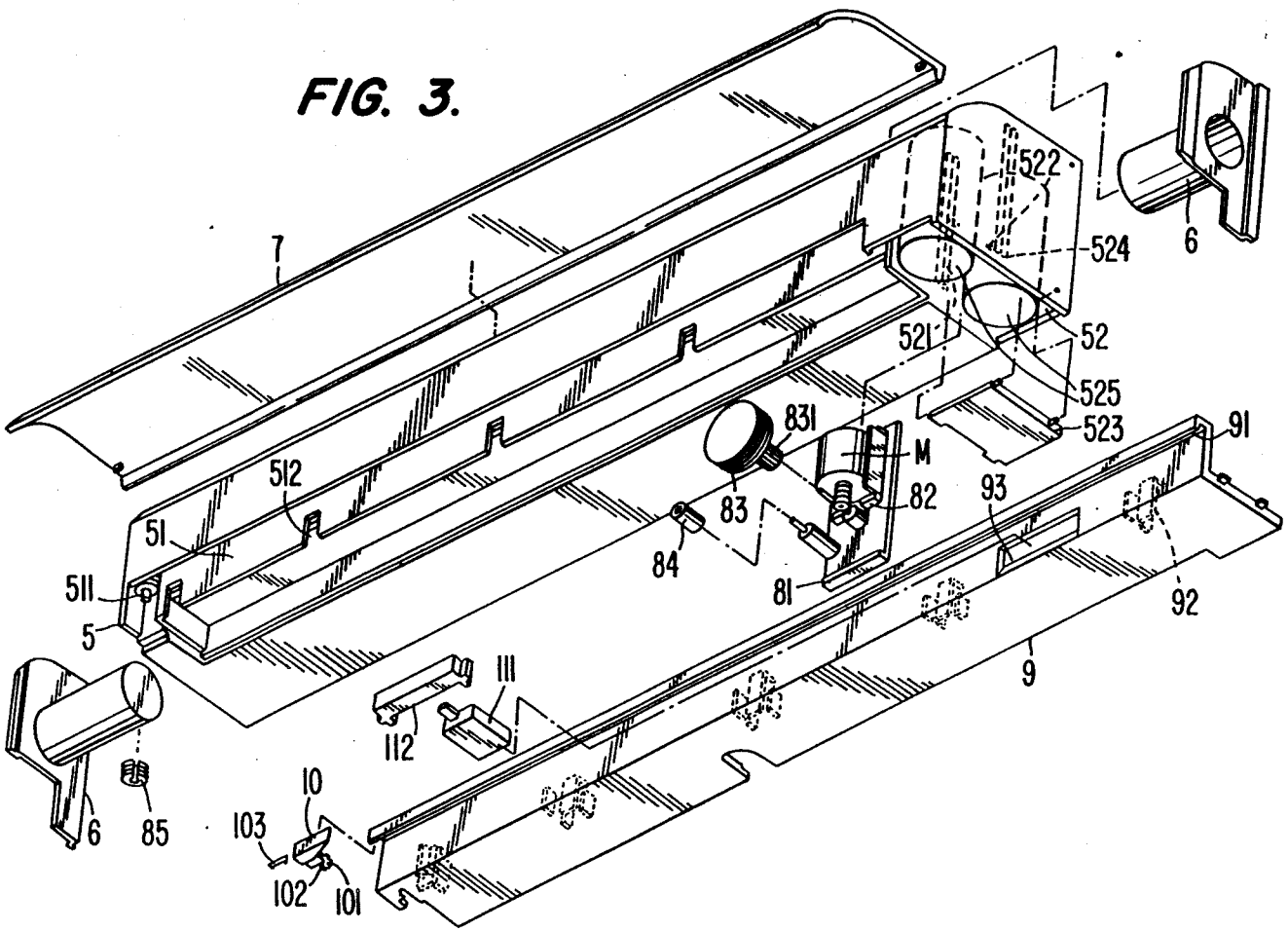
FIG. 3 is a perspective view of the exploded wrap dispenser of the present invention.
Figure 4:
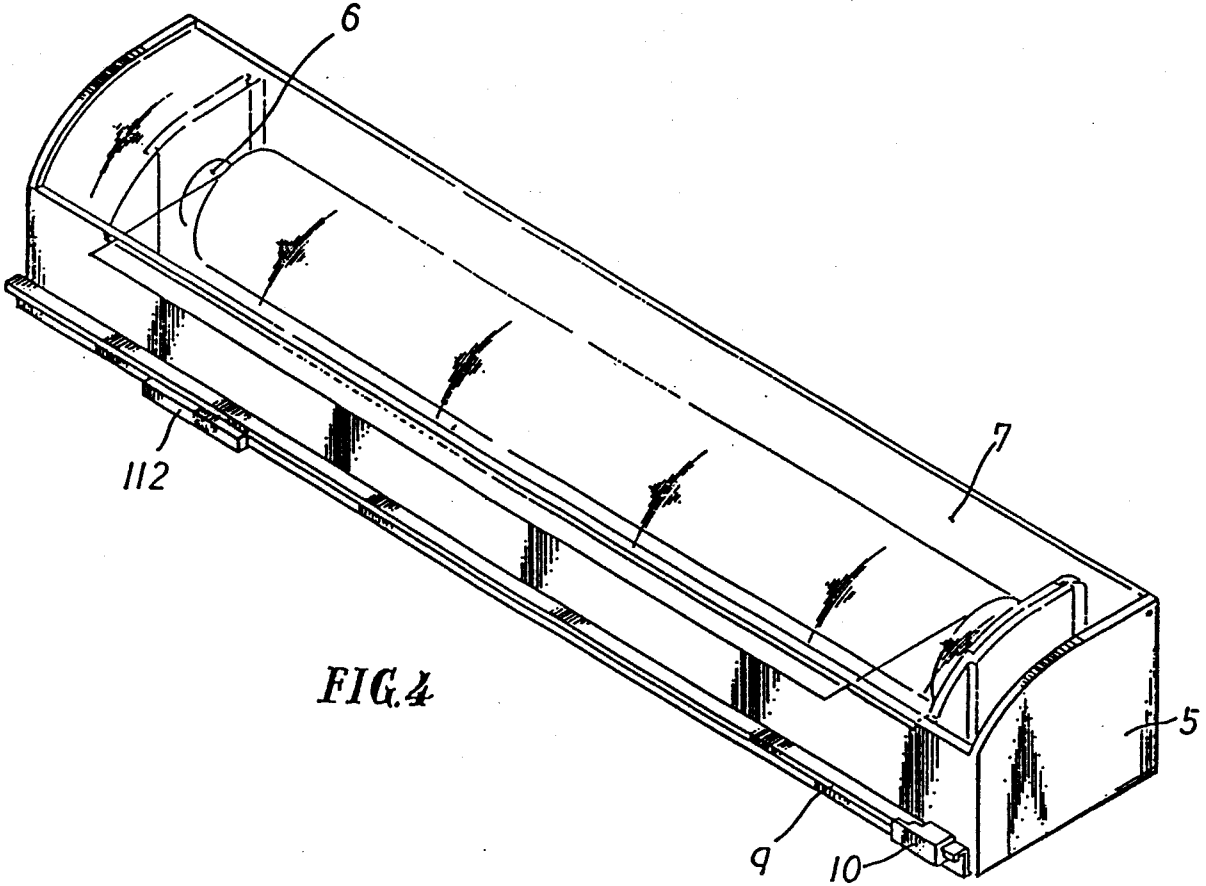
FIG. 4 is a front perspective view of the present invention.

As shown in FIGS. 3, 4, the present automatic wrap dispenser having a motor operated cutting device mainly comprises a housing 5 the upper portion of which is defined to have a reception room, and the lower portion thereof is defined to have an elongate trough 51 which is in communication at one end with a hollow mounting seat 52, and an upright fixing shaft 511 is disposed at the opposite side of housing 5. A number of spaced engagement recesses 512 are disposed on the edge of the rear wall of the trough 51. On each of the side walls of the mounting seat 52, a pair of protrusions are fixed thereon to form a guide groove 521 so that a partition board dividing the mounting seat into two chambers can be removably located in place. The front chamber is in communication with the axially disposed trough 51 and has a number of snap holes 522 defined on the side wall thereof. The rear chamber is adapted for the location of a number of batteries 525. A cap 523 is removably fixed on the top of the rear chamber by means of the engagement holes 524 defined on the opposite walls thereof for fixing the batteries in place.

A pair of roll supporting shafts 6 are fixed on the side walls of the upper portion of the housing 5 for the rotatable mounting of the roll 4 of thin plastic wrap.

An openable upper cover 7 is engaged with the housing 5, the cover 7 is defined to have a curved structure so that a larger space can be provided for the fixed roll 4 to freely rotate in operation.

Figure 7:
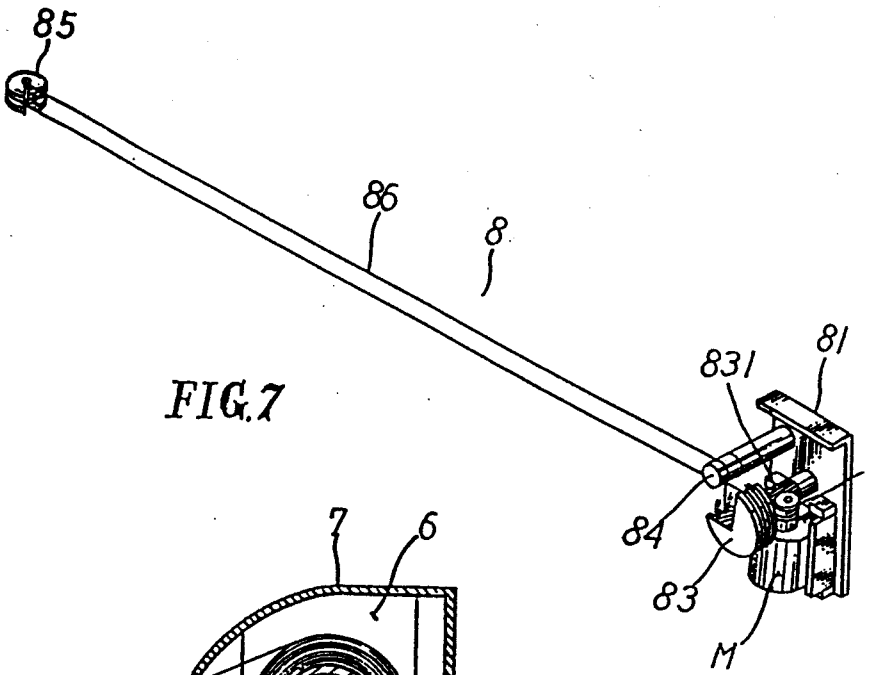
FIG. 7 is a perspective view showing the arrangement of the transmission mechanism of the present invention.

A transmission mechanism 8 includes the partition board 81 which is engaged with the guide grooves 521 to divide the mounting seat 52 into two chambers with a drive motor M vertically attached thereto. To the end of the motor shaft is attached a worm 82 which is engaged with a worm gear 831 of a double-stage wheel 83 disposed in orthogonal relation therewith so that the worm gear 831 can be actuated by the motor shaft to rotate clockwise and counter clockwise accordingly. An adjusting roller 84 rotatably mounted on the partition board 81 is disposed in parallel with the double-stage wheel 83. A rotatable fixing wheel 85 mounted on a pin shaft 511 fixed on the housing 5 is coupled to the double stage wheel 83 by means of a tightly extended pull cord 86 which is windingly engaged with one groove of the wheel 83, then is led over the adjusting roller 84 and through the rough 51 and linked with the fixing wheel 85 and is reversed to go across the rough 51 to engage with the other groove on the wheel 83, an shown in FIG. 7, so to form a loop.

Figure 5:
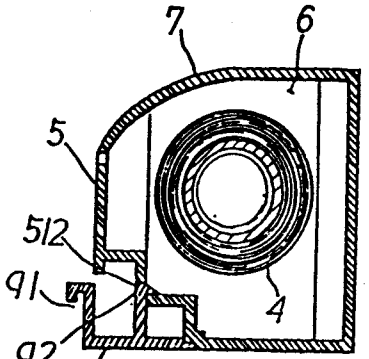
FIG. 5 is a sectional view of the present dispenser along the transverse direction.
Figure 6:
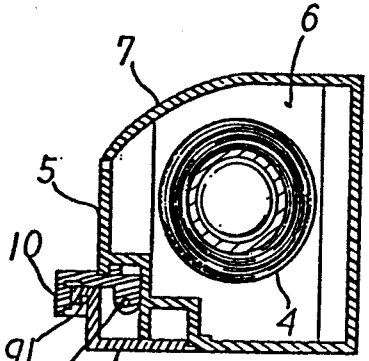
FIG. 6 is a sectional view showing the relation between the pull cord and the blade mount.

A bottom cover 9, having an axially disposed ditch 91 which is disposed along the edge of the downward extended wall of the cover, is provided with an equal number of snap pieces 92 to the engagement recesses 512 of the housing 5 so that the same can be joined with the housing 5 in assembly as shown in FIG. 5. An oblong opening 93 is disposed on the downward extended wall of the bottom cover 9. As illustrated in FIG. 5, the downward extended wall is kept a proper distance with respect to the housing 5 so that a room is defined therebetween.

A cutting blade mount 10 is operatively engaged with the groove 91 with the inner section thereof extended into the trough 51. A lug member 102 having an aperature 101 disposed thereon permits the pull cord 86 to operatively engage with the cutting blade mount 10. A cutting blade 103 is fixed on the mount 10.

Figure 8:
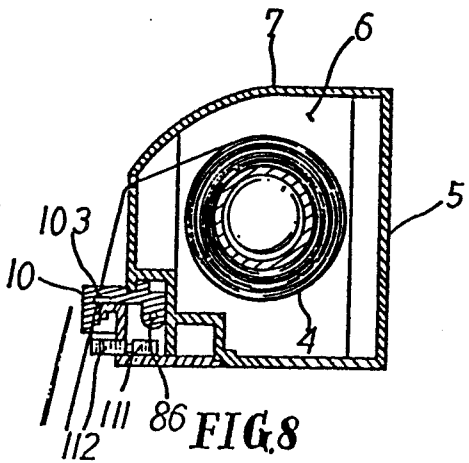
FIG. 8 is a diagram showing the location and operation of the switch button of the present invention.

A control system 11 having at least a pair of batteries 525 used as the power source which is connected to a limiting switch 111 as well as a motor M of a transmission mechanism 8 by way of an electrical cord. An operation button 112 is attached to the outer end of the limiting switch 111. The button 112 is led through the opening 93 and exposed outside of the bottom cover 9, as shown in FIG. 8. As illustrated in FIG. 4, the operation button 112 and the cutting blade mount 10 are located at respective end of the housing 5. By actuation or release of the operation button 112 to selectively control the conduction of the power source, the transmission mechanism is accordingly controlled.

In practical operation, the operator holds the front corners of an extended thin plastic wrap and pull the same outward smoothly from the housing 5 to a desired length with the dispensed wrap fully expanded, then the extended thin plastic wrap is held in tension and guided toward the housing 5 so that the rear portion of the extended wrap 4 can abut against the operation button 112 of the limiting switch 111, referring to FIG. 8, thereby the same is actuated to function; accordingly the motor M of the transmission mechanism 8 is made rotate clockwise. Thus, the double-stage wheel 83 is spinned to get one end of pull cord 86 winded and other end thereof released. As a result, the cutting blade mount 10 is moved along with the cord 86 toward the button 112 and cut the thin plastic wrap continuously and smoothly, and the dispensed wrap can be held by two hands of an operator. Thus, the wrap will not be messed up easily. Once, the wrap is detached, the button 112 is free from the abutment pressure exerted by the tightly held wrap, the limiting switch 111 will resume its inoperative position, and the motor M is thus made rotate counter-clockwise; in the mean time, the double-stage guide wheel 83 of the transmission mechanism 8 is made to operate in a reverse direction, compared with previous operation, so that the pull cord 86 will move the blade mount 10 away from the button 112. As soon as the blade mount 10 is returned to its original position, the motion of the transmission mechanism is terminated accordingly.

It has been clearly shown that the present improved wrap dispenser characteristically can permit an operator to dispense the plastic wrap evenly and smoothly without getting the same messed up by holding the extended wrap with two hands with the receprocal cutting blade moving against the to-be-dispensed wrap, permitting the same to be evenly detached from a roll thereof.

Although particular embodiments of the present invention have been illustrated and described, it will be apparent to those skilled in the art that various changes and modification, can be made without departing from the spirit of the present invention, and it is intended to cover in the appended claims all such changes and modifications that fall within the scope of the present invention.

What is claimed is:

1. An improved plastic wrap dispenser having an automatic cutting device disposed thereon comprising:

a housing having an upper reception room which permits the location of a pair of roll supporting members disposed on the opposite ends thereof so that a roll of the wrap can be housed in said upper reception room;

an openable upper cover disposed on top of said housing with the wrap extended outward therethrough;

an elongate trough disposed at the lower portion of said housing, which is associated with a bottom cover, one end of said trough extending to communicate with a mounting seat disposed at one side of said housing;

a power transmission mechanism disposed within said mounting seat;

a cutting blade mount slidably moved within said trough in back and forth manner with a blade mounted thereon;

a limiting switch engaged with an operation button extended out of the front edge of said bottom cover, permitting a downward pulled and tensioned plastic wrap to abut thereagainst for control operation;

a partition board to divide said mounting seat into two portions in one of which a number of batteries are housed with a cap removably attached thereon;

whereby the outward extended plastic wrap is pulled and abutting against said operation button to actuate said limiting switch which makes the power transmission mechanism operate so that the blade mount is moved to cut the extended wrap off the roll by means of a blade mounted thereon; once the operation button is released from the abutting pressure exerted by the extended wrap, the limiting switch is put in a non-operation position, and the transmission mechanism is made to operate in a reverse manner to bring the cutting blade mount back to its original position for next operation.

2. An improved plastic wrap dispenser as claimed in claim 1, wherein said transmission mechanism comprises a partition board disposed within said mounting seat so to seperate the same into two chambers; a motor vertically fixed on said partition board has a worm disposed at the end of the shaft thereof; a double stage guide wheel disposed in orthogonal relation with said motor has a worm gear mounted at the front end thereof which is engaged with said worm of said motor in operation; an adjusting roller is disposed adjacent to said double stage wheel and in parallel therewith; and a fixing wheel is disposed at the opposite side of said trough; an elongate pull cord is wound around said double stage guide wheel a number of times frist, then is led over said adjusting roller and through said trough to said fixing wheel and extended reversely therefrom to said double stage guide wheel, froming a loop, with said cutting blade mount being engaged with the looped pull cord so that the same can be operatively moved back and forth in said trough.

3. An improved plastic wrap dispenser as claimed in claim 1 wherein the mounting seat disposed on one side of said housing has a pair of guide grooves located on the opposite walls thereof respectively so that said partition board can be fixed in place to cut said mounting seat into two chambers.

4. An improved plastic wrap dispenser as claimed in claim 1 wherein the inner side wall of said trough is equipped with a number of spaced engagement recesses, and at the corresponding positions on said bottom cover, an equal number of snap pieces are disposed whereby said bottom cover can be attached to said housing.

5. An improved plastic wrap dispenser as claimed in claim 1 wherein said cutting blade mount has a transversely extended lug member disposed on one side thereof, on which an aperature is defined so that said pull cord can be led therethrough for engagement.

6. An improved plastic wrap dispenser as claimed in claim 1 further comprising a groove in the front portion of said bottom cover; and means for guiding said cutting blade mount in said groove.

7. An improved plastic wrap dispenser as claimed in claim 1 wherein said elongate trough walls provides a means for guiding said blade mount as said blade mount is moved to cut the extended wrap off the roll.

* * * * *